US005664371A

United States Patent [19]

Berliner

[11] Patent Number: 5,664,371

[45] Date of Patent: Sep. 9, 1997

[54] INFANT GATE

[76] Inventor: Allen Jay Berliner, 704 W. Woodcrest Ave., Brea, Calif. 92621

[21] Appl. No.: 546,392

[22] Filed: Oct. 20, 1995

[51] Int. Cl.[6] ..... E06B 7/00

[52] U.S. Cl. ..... 49/55; 49/57; 160/351

[58] Field of Search ..... 49/55, 50, 57, 49/463; 160/222, 351; 52/184, 186

[56] References Cited

U.S. PATENT DOCUMENTS

| | | | |
|---|---|---|---|
| 777,322 | 12/1904 | Wright . | |
| 4,399,635 | 8/1983 | Darga . | |
| 4,465,262 | 8/1984 | Itri et al. . | |
| 4,583,715 | 4/1986 | Wright . | |
| 4,607,455 | 8/1986 | Bluem et al. . | |
| 4,628,635 | 12/1986 | Malliard . | |
| 4,677,791 | 7/1987 | Larson et al. | 49/55 X |
| 4,685,247 | 8/1987 | Alam . | |
| 4,702,036 | 10/1987 | Johnson . | |
| 4,777,765 | 10/1988 | Johnson, Jr. . | |
| 4,787,174 | 11/1988 | Brown, III . | |
| 4,831,777 | 5/1989 | Johnson, Jr. . | |
| 4,884,614 | 12/1989 | Spurling . | |
| 4,944,117 | 7/1990 | Gebhard et al. | 49/55 |
| 4,984,619 | 1/1991 | Ellis . | |
| 5,022,197 | 6/1991 | Aragona | 52/184 X |
| 5,396,732 | 3/1995 | Anderson | 49/55 |
| 5,437,134 | 8/1995 | Donnelly | 49/55 X |

*Primary Examiner*—Kenneth J. Dorner
*Assistant Examiner*—Jeret Redman
*Attorney, Agent, or Firm*—John J. Connors; Connors & Assoc.

[57] ABSTRACT

An infant gate includes a pair of rails mounted along opposed lateral edges of a stair substantially parallel to each other, and a first gate section and a second gate section connected together so that the first and second gate sections may be selectively moved laterally relative to each other. A first support member has a pair of leg elements connected together at ends thereof at a right angle. One leg element is connected to the first gate section by a hinge member and the other leg element is connected to one of the rails. A second support member has a pair of leg elements connected together at ends thereof at a right angle. One leg element is connected to the second gate section by a hinge member and the other leg element connected to the other of the rails. Each of the first and second support members is moveable to different positions along the rail to which they are connected to enable the gate sections to be selectively positioned horizontally relative to the stair to which the gate sections are attached. Locking members along the rails lock the first and second support members into the selected position.

16 Claims, 3 Drawing Sheets

40
42
44
46
16
18
24
22
20a
10a
60
28
16b
34

INFANT GATE

BACKGROUND OF THE INVENTION

1. Field of the Invention

This invention relates to an infant gate, and more particularly, to an infant gate which may be detachably mounted to a stair of a staircase and adjusted to accommodate stairs of different widths, depths, and heights.

2. Background Discussion

Infant gates are used frequently to prevent tiny children from accessing a staircase and thereby prevent accidents. Many staircases have one, or both, sides open. Typically, the open side has a railing along it. In many situations, both sides of the staircase are open, with railings on each side. Such open staircases do not lend themselves to infant gates, which normally require that the gate be positioned between two opposing walls and fastened, for example, by pressure, or otherwise supported by the opposing walls.

If a gate is permanently mounted to a wall or a banister you can cause irreparable damage to these structures. Also, for a secure installation, you must locate the studs in the wall which may or may not line up with where you want the gate. This invention however would create no damage during installation or removal because you are simply screwing wood screws into stairs which are made entirely of wood and are usually covered by carpeting. The rails can be placed along the outermost edges of the stairs. The support members can then be locked onto the rails and the gate is secure. Unlocking the support members will allow you to take them off the rails, fold the support members along their hinges, put away the gate, and leave only the two unobtrusive rails on the steps for future installations of the gate.

SUMMARY OF THE INVENTION

The objective of this invention is to provide an infant gate which may be used with open staircases. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include improved child safety, ease of installation, portability and compactness for storage.

The first feature of the infant gate of this invention is that it has a gate member adapted to be removably attached to a pair of rails mounted on a stair (As used herein, stair includes the landing of a staircase.)

The second feature is that the width of the gate member is adjustable, so that is adapted to fit stairs of varying widths. For example, it may include a first gate section and a second gate section connected together so that these sections may be selectively moved laterally relative to each other.

The third feature is that the gate may be supported vertically. For example, each of the gate sections may include adjustable feet members that are adjusted to rest on a supporting structure such as a stair or landing.

The fourth feature is that the gate includes a pair of support members. Preferably, each support members has an L-shaped configuration, and the support members are attached by hinge members to the gate sections, enabling the support members to be folded inward towards the gate sections for storage. One support member has one end connected to the first gate section and another end connected to one of the rails mounted on a stair. The other support member has one end connected to the second gate section and another end connected to the other of said rails mounted on the same stair. Each of the support members has a locking section which detachably interlocks with the rail to which it is connected to attach the first and second gate sections to the rails. Each of the support members is moveable to different positions along the rail to which they are connected to enable the gate sections to be selectively positioned horizontally relative to the stair to which the gate sections are attached. This will accommodate stairs of varying depths.

The fifth feature is that the support members have a gripping section movable between a normally closed position where the gripping section engages the rail to which it is attached and an extended position that allows the support member to be detached from said rail. The gripping section has a spring element which urges said gripping section into a closed position.

The sixth feature is that the rails include a series of aligned openings and the support members include a series of fingers which are received in the openings in the rails during attachment of the rails and the support members.

The seventh feature is that the gate sections may also include a locking member which locks the gate sections together.

BRIEF DESCRIPTION OF THE DRAWING

The preferred embodiments of this invention, illustrating all its features, will now be discussed in detail. These embodiments depict the novel and non-obvious infant gate of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

Figure 1:
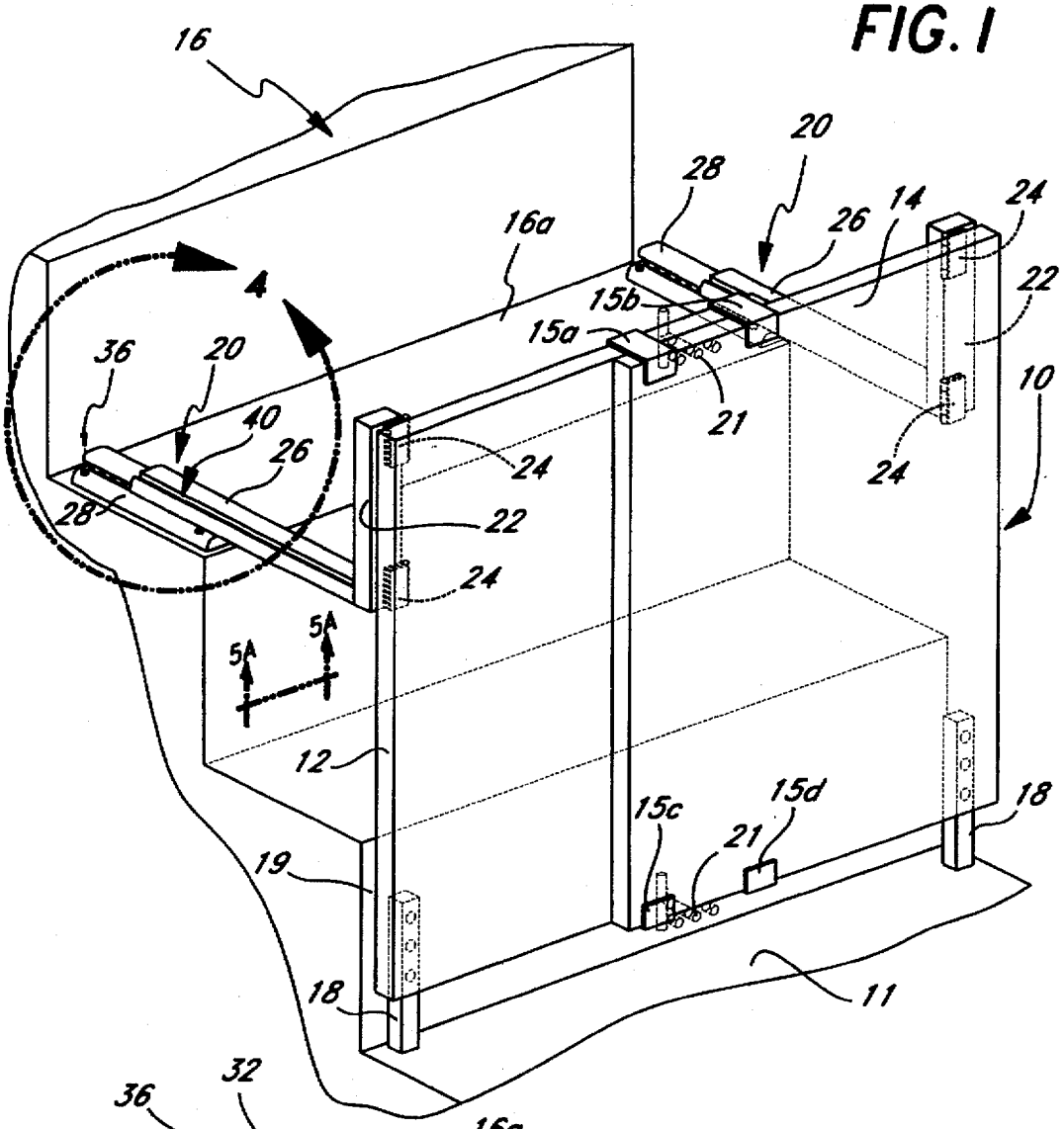
FIG. 1 is a perspective view of the infant gate of this invention, mounted on a staircase having opposed open sides (the railings normally present are omitted).

As best illustrated in FIG. 1, the infant gate 10 of this invention includes a pair of rigid gate sections 12 and 14, preferably planer members made of wood or plastic, which are connected together by two pairs of spaced-apart clamps 15*a* and 15*b* along the top edge and clamps 15*c* and 15*d* along the bottom edge. These clamps 15*a*–15*d* enable the two gate sections 12 and 14 to move relative to each other so that they may be adjusted to correspond to the width of the staircase 16. (Any other gate structure that allowed the width of the gate to be varied to equal the width of the staircase 16 would be equivalent for the purposes of this invention.) Preferably, there is a foot member 18 extending downward from the lateral edge of each gate section. These feet 18 may be adjusted to engage the landing 11. There are spring pins 21 seated in aligned holes in the gate sections 12 and 14 which locks the two gate sections 12 and 14 together when they have been moved laterally to block the staircase 16.

Figure 4:
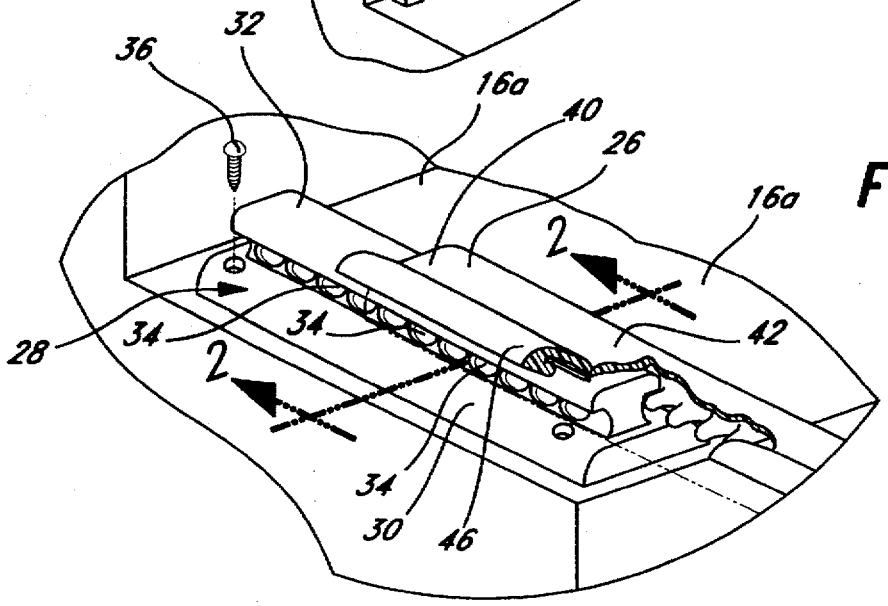
FIG. 4 is an enlarged, fragmentary perspective view showing a rail and support member connected to the rail.
Figure 3:
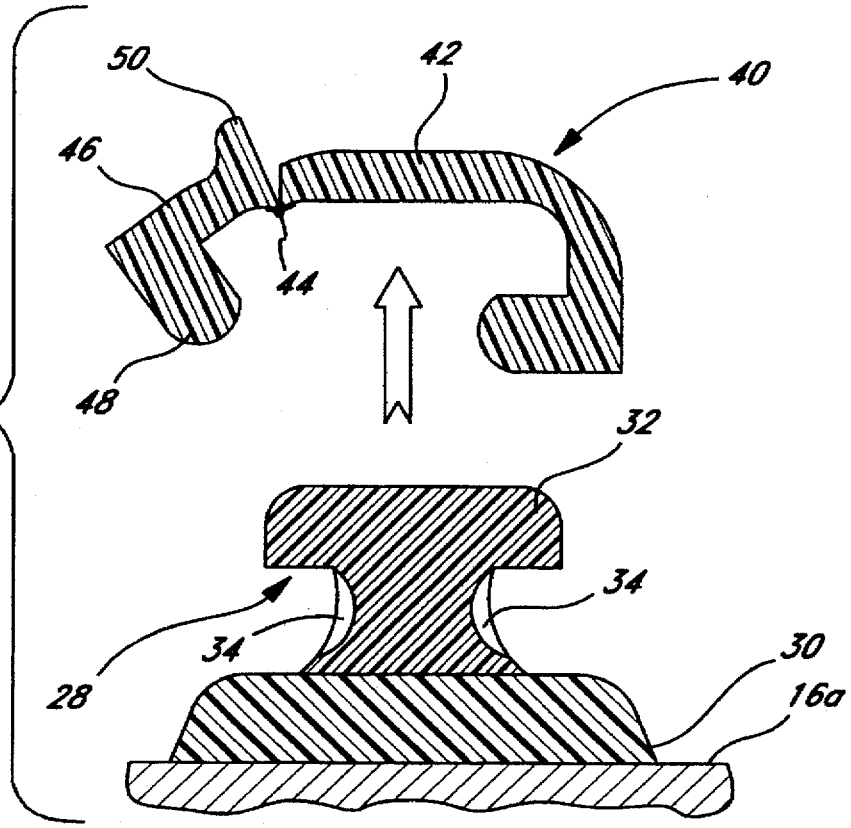
FIG. 3 is a cross-sectional view similar to that shown in FIG. 2 showing a support member being unlocked and separated from the rail.

Along the lateral outer edge at each gate section 12 and 14 is an L-shaped support member 20. Alternately, an inverted T-shaped member could be used, which is equivalent since the inverted T-shaped member includes an L-shaped portion. Each support member 20 includes a vertical leg 22 attached by a pair of hinges 24 to the upper lateral edge portion of the gate sections 12 and 14, and a horizontal leg section 26 mounted to a rail 28 attached to the outer, lateral edge of the stair. The rails 28 enable the user to adjust the gate 10 in and out horizontally relative to the stair 16*a*. As best depicted in FIGS. 3 and 4, each raft 28 has a T-shaped configuration and includes a base 30 having connected thereto an upstanding vertical post 32 which has a series of aligned openings or indentations 34. Screws 36 fasten the base 30 of the rails 28 to the top surface of the stair 16*a*, and the rails 28 are aligned so that they are parallel to each other and are spaced apart approximately the width of the stair 16*a*.

Figure 2:
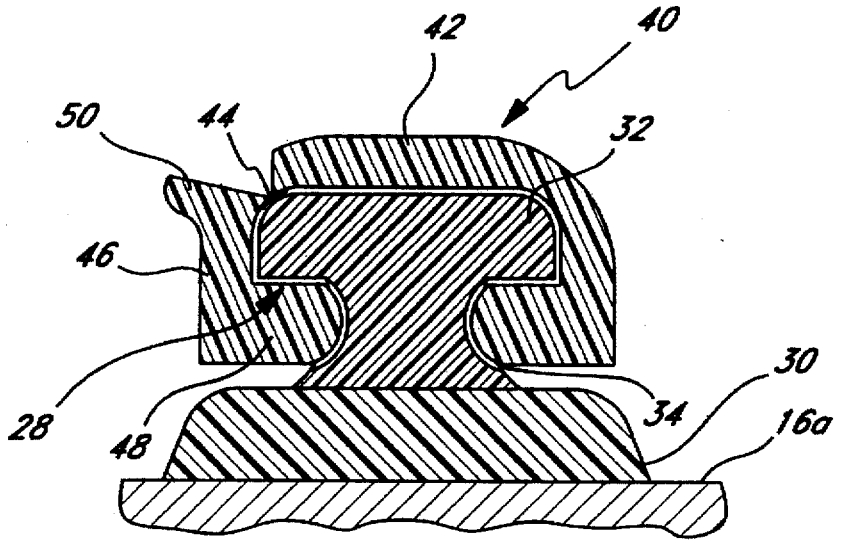
FIG. 2 is a cross-sectional view taken along line 2—2 of FIG. 4 showing a support member locked to a rail.

As best depicted in FIGS. 3 through 5B, the horizontal leg 26 of each support member 20 includes a locking section 40 which grips and locks onto the posts 32 of the rails 28. This locking section 40 includes a two-piece member which has an arm member 42 connected by a spring 44 to a hand member 46 so that these members are hinged together. The hand member 46 has a plurality of spaced apart fingers 48 in series along an inside edge of the hand member. As shown in FIG. 2, the arm member 42 and hand member 46 in the locking position, partially surround the post with the fingers 48 forced by the action of the springs 44 to firmly grip the rail 28 to hold the support member 20 in the selected, relative position on the rail 28 to which it is attached. By pressing against a lever 50 on the exterior of the arm member 46, the force of the spring 44 is overcome so that the leg 26 of the support member 20 may be moved horizontally along the rail 28 to position selectively the gate sections 12 and 14, so that the lower ends of the gate sections presses against a riser 19 (FIG. 1) of a stair in the staircase 16 lower than stair 16*a*, and a portion of the horizontal leg 26 extends outward from the stair 16*a* so that the gate sections 12 and 14 are substantially vertical, and the leg 26 are substantially horizontal.

To remove the gate 10 from blocking the staircase, the user simply presses against the lever 50 to pivot the hand member 46 about the spring hinge 44 to the open position shown in FIG. 3, lifting the support member 20 off the post 32. The lock 21 is unlocked and the two gate sections 12 and 14 are separated from each other. The support members 20 may then be pushed inwardly so that they each pivot about the hinges 24 and move to a position substantially flush against the inside of the gate section to which they are attached.

Figures 5A, 5B, 6:
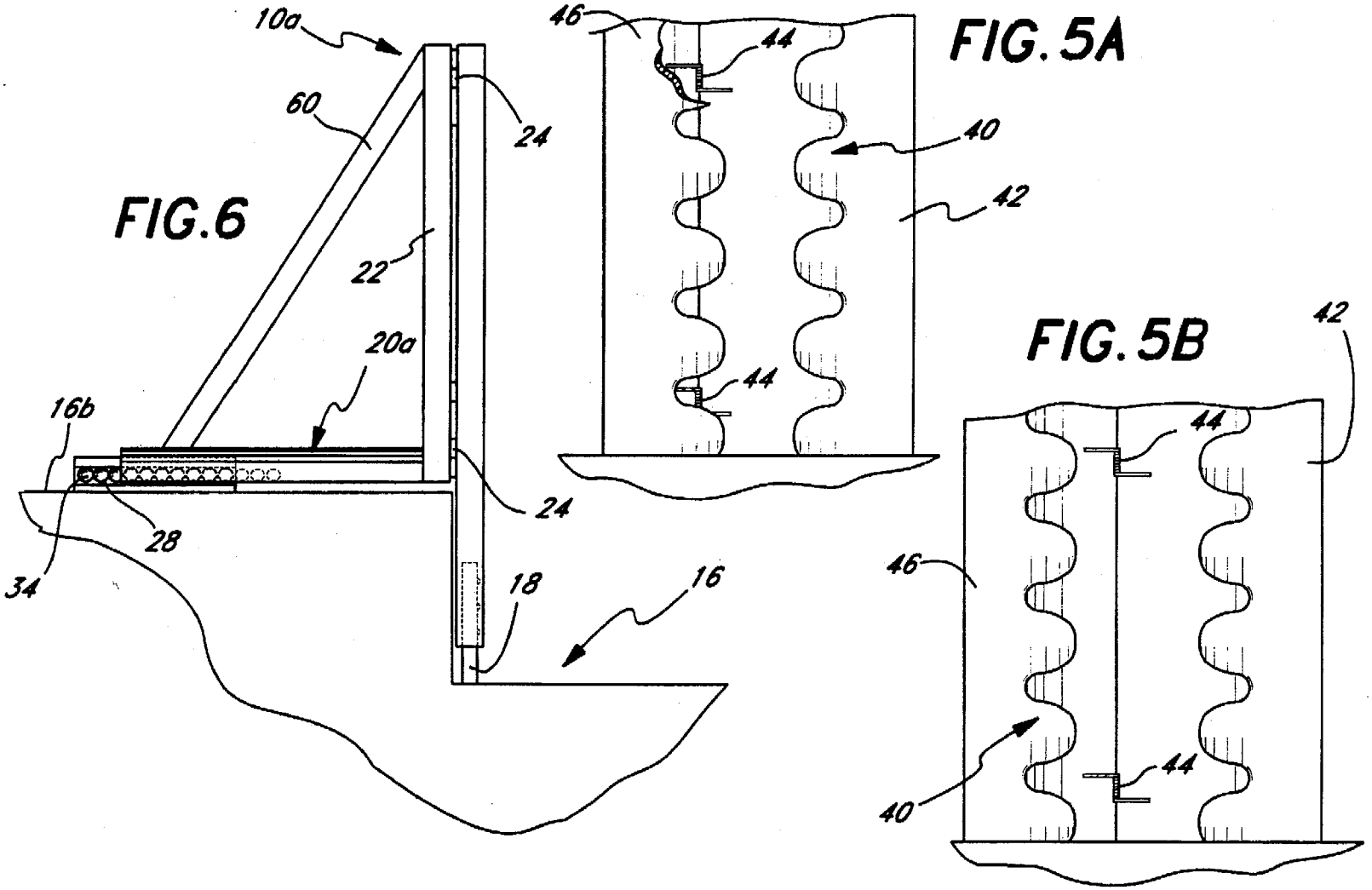
FIG. 5A is a cross-sectional view taken along line 5A—5A of FIG. 1.
FIG. 5B is a view similar to that of FIG. 5A showing the locking section of the support member in a fully open position.
FIG. 6 is a side-elevational view of an alternate embodiment of this invention, useful for the top stair (landing) of a staircase.

As shown in FIG. 6, an alternate embodiment of this invention, infant gate 10*a*, has been designed to fit at the top stair or landing 16*b* of the staircase 16. In this gate 10*a*, each of the L-shaped support members 20 have a brace 60 that connects the vertical leg 22 and the horizontal leg 26 of the support members 20 together. The vertical leg 22 in gate 10*a* is longer than the vertical leg 22 in gate 10, so that there will be no intermediate step between the support members 20 and the feet 18 of the gate sections 12 and 14.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. An infant gate removably attached to a pair of rails mounted on a stair having a predetermined width, including a gate member having opposed sides, said gate member being adjustable to substantially equal the width of the stair, a first support member having one end connected to one side of the gate member and another end connected to one of said rails, and a second support member having one end connected to the other side of the gate member and another end connected to the other of said rails, each of said support members having a locking section which detachably interlocks with the rail to which it is connected to attach the gate member to the rails, each of said first and second support members being moveable to different positions along the rails to which they are connected to enable the gate member to be selectively positioned horizontally relative to the stair to which said gate member is attached, said rails including a series of aligned openings and the support members including at least one finger which is received in an opening in the rails during attachment of the rails and the support members.

2. The infant gate of claim 1 where the gate member includes a first gate section and a second gate section connected together so that said first and second gate sections may be selectively moved laterally relative to each other.

3. The infant gate of claim 2 where the gate sections include a locking member which locks the gate sections together.

4. The infant gate of claim 1 where the support members have an L-shaped configuration.

5. The infant gate of claim 1 where the support members are attached by hinge members to the gate member, enabling the support members to be folded inward towards the gate member for storage.

6. The infant gate of claim 1 where a portion of each of the support members has a gripping section movable between a normally closed position where the gripping section engages the rail to which it is attached and an extended position that allows the support member to be detached from said rail, each of said gripping sections having a spring element which urges said gripping sections into to closed positions.

7. The infant gate of claim 1 where the gate member includes adjustable feet members that provide vertical support.

8. An infant gate removably attached to a stair, including a first gate section and a second gate section connected together so that said first and second gate sections may be selectively moved laterally relative to each other, a first L-shaped support member having one end connected to the first gate section by a hinge member and another end connected to the stair, a second L-shaped support member having one end connected to the second gate section by a hinge member and another end connected to the stair, and a pair of rails attached to the stair, and each support member being attached to one of said rails, said rails each including a series of aligned openings and the support members each including at least one finger which is received in an opening in the rails during attachment of the rails and the support members, a portion of each of the support members having a gripping section movable between a normally closed position where the gripping section engages the rail to which it is attached and an extended position that allows the support member to be detached from said rail, said gripping sections each having a spring element which urges said gripping sections into to closed positions.

9. The infant gate of claim 8 where each of the support members has a locking section which detachably interlocks with the rail to which it is connected to attach the first and second gate sections to the rails, each of said support members being moveable to different positions along the rails to which they are connected to enable the gate sections to be selectively positioned horizontally relative to the stair to which said gate sections are attached.

10. The infant gate of claim 8 where each of the gate sections include adjustable feet members that provide vertical support.

11. The infant gate of claim 8 where the gate sections include a locking member which locks the gate sections together.

12. An infant gate, including a pair of rails mounted along opposed lateral edges of a stair substantially parallel to each other, a first gate section and a second gate section connected together so that said first and second gate sections may be selectively moved laterally relative to each other, a first support member having a pair of leg elements connected together at ends thereof at a right angle, one leg element connected to the first gate section by a hinge member and the other leg element connected to one of said rails, and a second support member having a pair of leg elements connected together at ends thereof at a right angle, one leg element connected to the second gate section by a hinge member and the other leg element connected to the other of said rails, each of said first and second support members being moveable to different positions along the rails to which they are connected to enable the gate sections to be selectively positioned horizontally relative to the stair to which said gate sections are attached, and locking members along the rails to lock the first and second support members into the selected position, said rails and leg elements connected thereto including at least one finger which is received in an opening during attachment of the rails and the support members to interlock the rails and leg elements together at selected positions along the rails.

13. The infant gate of claim 12 where a portion of the support members has a gripping section movable between a normally closed position where the gripping section engages the rail to which it is attached and an extended position that allows the support member to be detached from said rail, said gripping section having a spring element which urges said gripping section into to closed position.

14. The infant gate of claim 13 where each of the gate sections include adjustable feet members that provide vertical support.

15. The infant gate of claim 14 where the gate sections include a locking member which locks the gate sections together.

16. An infant gate removably attached to a pair of rails mounted on a stair having a predetermined width, including a gate member having opposed sides, said gate member being adjustable to substantially equal the width of the stair, a first support member having one end connected to one side of the gate member and another end connected to one of said rails, and a second support member having one end connected to the other side of the gate member and another end connected to the other of said rails, each of said support members having a locking section which detachably interlocks with the rail to which it is connected to attach the gate member to the rails, each of said first and second support members being moveable to different positions along the rails to which they are connected to enable the gate member to be selectively positioned horizontally relative to the stair to which said gate member is attached, said rails and support members including interlocking elements comprising an opening and at least one finger which is received in the opening during attachment of the rails and the support members.

* * * * *